US009393829B2

(12) United States Patent
Kuno

(10) Patent No.: US 9,393,829 B2
(45) Date of Patent: Jul. 19, 2016

(54) STAMPING DEVICE

(71) Applicant: Roland DG Corporation, Hamamatsu-shi, Shizuoka (JP)

(72) Inventor: Tsutomu Kuno, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 14/606,060

(22) Filed: Jan. 27, 2015

(65) Prior Publication Data

US 2015/0210102 A1 Jul. 30, 2015

(30) Foreign Application Priority Data

Jan. 28, 2014 (JP) ..... 2014-012970

(51) Int. Cl.

| | |
|---|---|
| ***B41K 3/62*** | (2006.01) |
| ***B41F 1/38*** | (2006.01) |
| ***B44B 5/00*** | (2006.01) |
| *B41K 3/46* | (2006.01) |
| *B41F 1/06* | (2006.01) |
| *B41K 3/02* | (2006.01) |

(52) U.S. Cl.

CPC ..... *B44B 5/0052* (2013.01); *B41F 1/38* (2013.01); *B41K 3/62* (2013.01); *B44B 5/0019* (2013.01); *B41F 1/06* (2013.01); *B41K 3/02* (2013.01); *B41K 3/46* (2013.01)

(58) Field of Classification Search

None

See application file for complete search history.

(56) References Cited

U.S. PATENT DOCUMENTS

| | | | | | |
|---|---|---|---|---|---|
| 1,631,060 | A * | 5/1927 | Putnam | 101/301 |
| 2,025,392 | A * | 12/1935 | Knitter | 271/165 |
| 4,044,676 | A * | 8/1977 | Hudson | 101/297 |
| 4,257,323 | A * | 3/1981 | Crasnianski | 101/41 |
| 4,635,548 | A * | 1/1987 | Pensky et al. | 101/319 |
| 2013/0206026 | A1 * | 8/2013 | Konik | 101/368 |

FOREIGN PATENT DOCUMENTS

GB 381360 A * 10/1932

* cited by examiner

*Primary Examiner* — Jill Culler

(74) *Attorney, Agent, or Firm* — Keating and Bennett, LLP

(57) ABSTRACT

A stamping device is configured to perform stamping on various processing targets that are significantly different in thickness. The stamping device that forms a stamping indentation on a surface of a processing target includes a processing tool configured to be movable in three axis directions perpendicular to one another, a first base member that supports the processing tool, and a second base member including a securing member configured to secure the processing target, detachably attached thereto and is detachably attached to first base member. The processing tool is located above the second base member.

10 Claims, 10 Drawing Sheets

STAMPING DEVICE

The present application claims priority from Japanese Patent Application No. 2014-012970 filed on Jan. 28, 2014, which is incorporated by reference herein in its entirety.

BACKGROUND OF THE INVENTION

1. Field of the Invention

The present invention relates to a stamping device that is configured to form a desired image on a surface of a processing target by stamping.

2. Description of the Related Art

Conventionally, a stamping device is known that forms a desired image, for example, a photo image, a two-dimensional symbol or the like by forming a plurality of dot-like stamping indentations on a surface of a processing target formed of, for example, a metal material that is plastically deformable relatively easily such as gold, platinum, brass, aluminum, stainless steel or the like, or a resin material such as acrylic resin or the like. An example of the two-dimensional symbol is a two-dimensional code including squares called "cells" arrayed in a matrix; specifically, a QR code (registered trademark), a data matrix or the like. Such a stamping device stamps a tip of a needle-like processing tool on a surface of a processing target secured by a securing jig, so that a plurality of dot-like stamping indentations are formed on the surface.

Now, such a stamping device will be described in detail with reference to the drawings. FIG. 9 is a perspective view showing a structure of a conventional stamping device 100. FIG. 10 is a perspective view showing a structure of a securing jig of the stamping device 100. FIG. 9 shows a partially cut-out view of the stamping device 100 for easier understanding. In FIG. 9 and FIG. 10, X axis, Y axis and Z axis are perpendicular to one another, and the stamping device 100 is placed on a plane formed by the X axis and the Y axis. In FIG. 9 and FIG. 10, L refers to the left side of the X axis and R refers to the right side of the X axis as seen from a person facing the stamping device 100. F refers to the front side of the Y axis and Re refers to the rear side of the Y axis as seen from a person oriented in the same direction as the stamping device. U refers to the up side of the Z axis and D refers to the down side of the Z axis.

As shown in FIG. 9, the conventional stamping device 100 includes a housing 101. The housing 101 includes a flat plate-like base member 102. A carriage 116, a stamping head 118, and a securing jig 120 are located inside the housing 101. The carriage 116 is movable in an X axis direction, a Y axis direction and a Z axis direction by a moving mechanism (not shown). The stamping head 118 is held by the carriage 116. Because of such a structure, the stamping head 118 is movable three-dimensionally. The securing jig 120 secures a processing target 200. The securing jig 120 is secured to a top surface 102*a* of the base member 102.

The securing jig 120 is detachably attached to a front portion of the base member 102. As shown in FIG. 10, the securing jig 120 includes a flat plate-like base table 140. On a top surface 140*a* of the base table 140, plate-like members 142*a* and 142*b* extend in the X axis direction while being substantially parallel to each other. The plate-like members 142*a* and 142*b* sandwich the processing target 200 shown in FIG. 9 and thus secure the processing target 200 to the securing jig 120. With such a structure, the stamping head 118 is moved by the carriage 116 three-dimensionally with respect to the processing target 200 to perform stamping on the surface 200*a* of the processing target 200.

However, with the above-described conventional stamping device 100, a thickness T (a length in the Z axis direction) of the processing target 200 shown in FIG. 9 needs to be shorter than a distance in the Z axis direction between a bottom end of a processing tool 136 of the stamping head 118 located at an uppermost position thereof and the top surface 140*a* of the base table 140 (hereinafter, the distance will be referred to as the "distance between the processing tool 136 and the base table 140"). When the thickness T of the processing target 200 is longer than or equal to the distance between the processing tool 136 and the base table 140, the processing target 200 cannot be secured to the securing jig 120. More specifically, there is a limitation on the thickness T of the processing target 200 on which stamping can be performed, and the thickness T is shorter than the distance between the processing tool 136 and the base table 140. Because of such a situation, a stamping device capable of performing stamping with no limitation on the thickness T of the processing target 200 is desired but not provided in the prior art.

SUMMARY OF THE INVENTION

Accordingly, various preferred embodiments of the present invention provide a stamping device capable of performing stamping on any of various processing targets which are significantly different in thickness.

A stamping device according to a preferred embodiment of the present invention is configured to perform stamping on a surface of a processing target. The stamping device includes a processing tool configured to be movable in three axis directions perpendicular to one another, a first base member that supports the processing tool, and a second base member detachably attached to one surface of the first base member. A securing member that secures the processing target is detachably attached to the second base member, and the processing tool is located above the second base member.

According to a preferred embodiment of the present invention, the second base member includes a first plate-shaped member, a second plate-shaped member extending upward from one end of the first plate-shaped member, and a base plate detachably attached the first plate-shaped member and the second plate-shaped member and having the securing member detachably attached thereto, the second plate-shaped member is detachably attached to the one surface of the first base member, and a stamping direction of the processing tool matches a direction in which the base plate and the first plate-shaped member overlap each other.

According to a preferred embodiment of the present invention, the second plate-shaped member is provided with a first plate member extending in one direction from one end of the second plate-shaped member and is also provided with a second plate member extending in another direction opposite to the one direction from another end of the second plate-shaped member opposite to the one end of the second plate-shaped member, in a state in which the second base member is attached to the one surface of the first base member, the second plate member is in contact with one side surface of the first base member that crosses the one surface of the first base member, and in a state in which the base plate is attached to the first plate-shaped member and the second plate-shaped member, one surface of the base plate is in contact with the second plate-shaped member, and the first plate member is in contact with one side surface of the base plate that crosses the one surface of the base plate.

According to a preferred embodiment of the present invention, the second plate-shaped member is provided with a first protrusion member, and the first base member is provided with a first hole in the one surface thereof, the first hole is engageable with the first protrusion member, the base plate is provided with a second protrusion member, and the first plate-shaped member is provided with a second hole engageable with the second protrusion member; the first protrusion member and the first hole are engaged with each other, and thus the second plate-shaped member is in contact with the one surface of the first base member and also the second plate member is in contact with the one side surface of the first base member, and the second protrusion member and the second hole are engaged with each other, and thus the one surface of the base plate is in contact with the second plate-shaped member and also the first plate member is in contact with the one side surface of the base plate.

According to a preferred embodiment of the present invention, the base plate is provided with a third hole to which the securing member is attachable, and in a state in which the based plate is attached to the first plate-shaped member, the second hole is located below the third hole.

According to a preferred embodiment of the present invention, the second plate member is provided with a third protrusion member, and the first base member is provided with a recessed portion in the one side surface thereof, the recessed portion being engageable with the third protrusion member, and the third protrusion member and the recessed portion are engaged with each other, and thus the second plate member is in contact with the one side surface of the first base member.

According to a preferred embodiment of the present invention, the first plate member is provided with a first engagement member that is engageable with the first base member, and another side surface of the first base member that is opposite to the one side surface thereof is provided with a first latch fastener engageable with the first engagement member.

According to a preferred embodiment of the present invention, the second plate member is provided with a second engagement member that is located at a position different from that of the first engagement member and is engageable with the first base member, and the one side surface of the first base member is provided with a second latch fastener engageable with the second engagement member.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
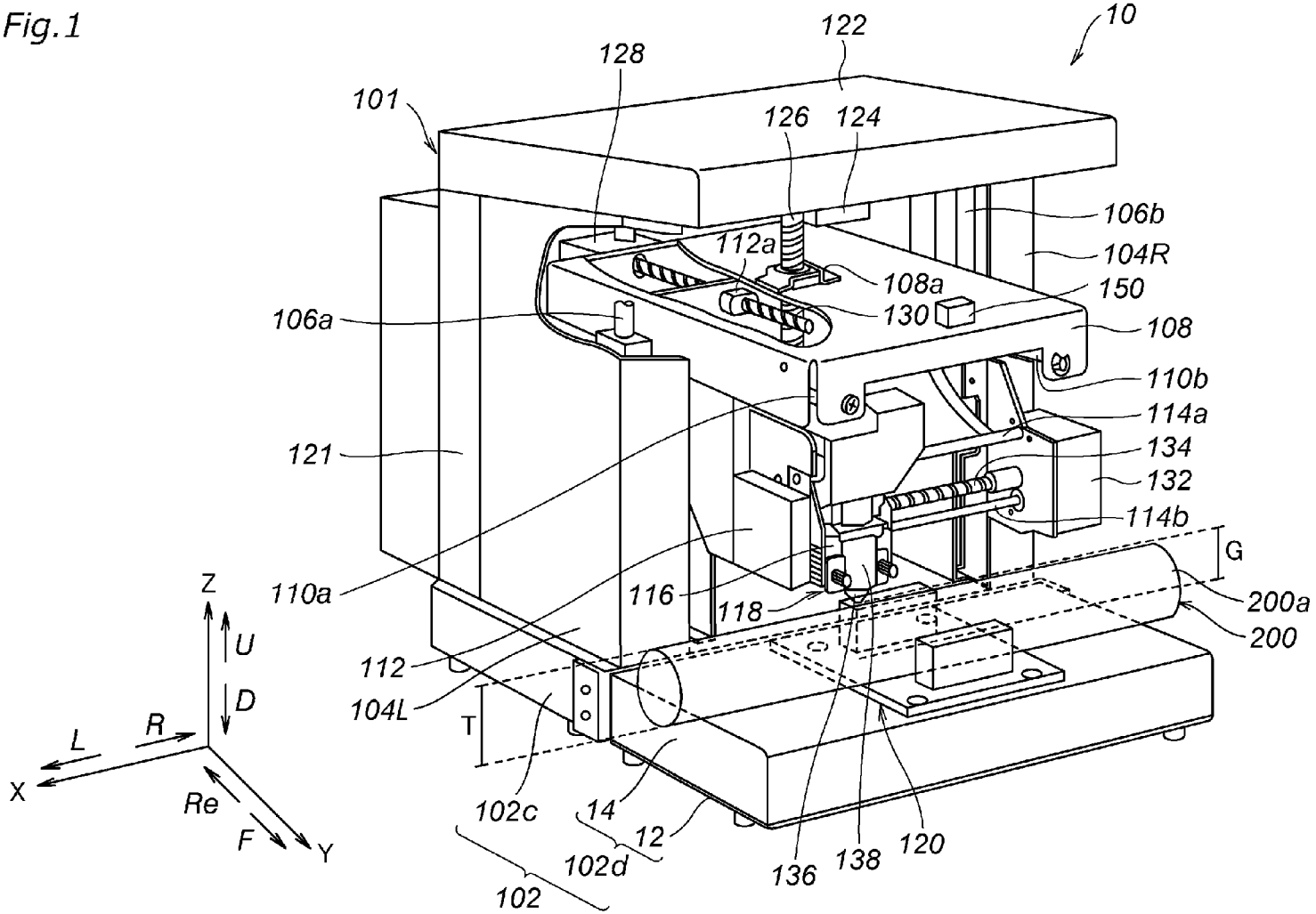
FIG. 1 is a partially cut-out perspective view of a stamping device according to a preferred embodiment of the present invention.

Hereinafter, preferred embodiments of the present invention will be described with reference to the drawings. In the following description, elements that are the same or substantially the same as, or corresponding to, those in the above-described conventional stamping device will bear the same reference signs. As shown in FIG. 1, X axis, Y axis and Z axis are perpendicular to one another. A stamping device is placed on a plane defined by the X axis and the Y axis. In FIG. 1 and the other figures, L refers to the left side of the X axis and R refers to the right side of the X axis as seen from a person facing the stamping device. F refers to the front side of the Y axis and Re refers to the rear side of the Y axis as seen from a person oriented in the same direction as the stamping device. U refers to the up side of the Z axis and D refers to the down side of the Z axis. These directions are defined merely for the sake of explanation, and do not limit in any way the form of installing the stamping device according to various preferred embodiments of the present invention.

As shown in FIG. 1, a stamping device 10 in this preferred embodiment includes a housing 101. The housing 101 includes a base member 102, a rear member 121, a side member 104L, a side member 104R, and a top member 122. The base member 102 includes a first base member 102*c* and a second base member 102*d* provided to the front of the first base member 102*c*. The first base member 102*c* has a height and a width that are equal or substantially equal to those of the second base member 102*d*, respectively. Herein, the term "width" refers to a length in the X axis direction. The rear member 121 is provided vertically or substantially vertically on a top surface 102*c*1 (FIG. 3) of the first base member 102*c*. The side member 104L is secured to the rear member 121 and is provided vertically on a left portion of the first base member 102*c*. Similarly, the side member 104R is secured to the rear member 121 and is provided vertically on a right portion of the first base member 102*c*. The top member 122 is provided on top ends of the rear member 121 and the side members 104L and 104R so as to face the first base member 102*c* and the second base member 102*d*.

Above the first base member 102*c*, a stamping head 118 and a moving mechanism that moves the stamping head 118 three dimensionally, namely, in an X axis direction, a Y axis direction and a Z axis direction are provided. The moving mechanism will be described later in detail. On the second base member 102*d*, a securing jig (securing member) 120 that secures a processing target 200 is detachably attached.

Figure 2:
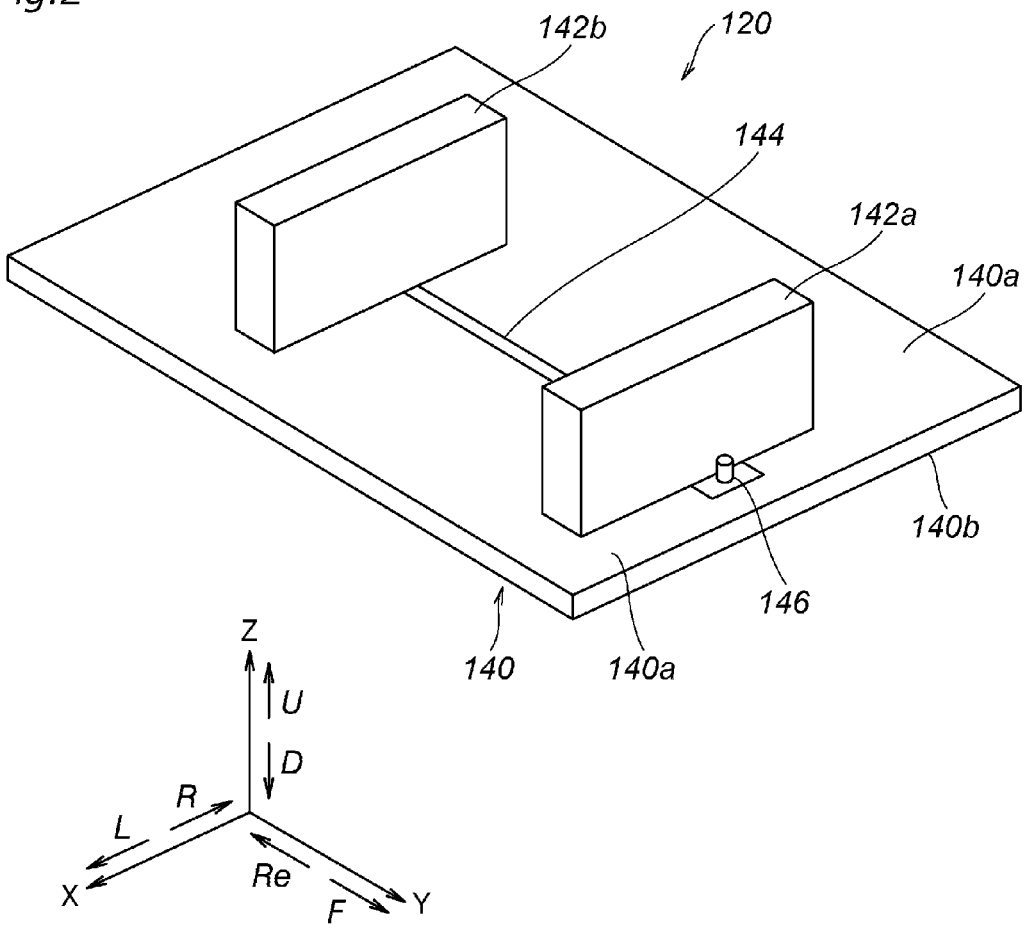
FIG. 2 is a perspective view of a securing jig in the stamping device according to a preferred embodiment of the present invention.

As shown in FIG. 2, the securing jig 120 includes a flat plate-shaped base table 140. On a top surface 140*a* of the base table 140, plate-shaped members 142*a* and 142*b* extend in the X axis direction while being parallel or substantially parallel to each other. A groove 144 is provided in the base table 140 in the Y axis direction. The plate-shaped members 142*a* and 142*b* are movable in the Y axis direction along the groove 144 while being parallel or substantially parallel to the X axis direction. The plate-shaped members 142*a* and 142*b* sandwich the processing target 200 shown in FIG. 1 and thus secure the processing target 200 to the securing jig 120.

The plate-shaped member 142*a* is provided with a stopping mechanism 146 that stops, at an arbitrary position in the groove 144, the movement of the plate-shaped member 142*a* in a direction away from the plate-shaped member 142*b*. Similarly, the plate-shaped member 142*b* is provided with a stopping mechanism (not shown) that stops, at an arbitrary position in the groove 144, the movement of the plate-shaped member 142*b* in a direction away from the plate-shaped member 142*a*.

The processing target 200 is secured to the securing jig 120 in the following manner. First, the plate-shaped member 142*a* is located at a foremost position of the groove 144 whereas the plate-shaped member 142*b* is located at a rearmost position of the groove 144. Next, the processing target 200 is placed between the plate-shaped members 142*a* and 142*b*. Then, the plate-shaped member 142*a* is moved rearward whereas the plate-shaped member 142*b* is moved forward. Thus, the processing target 200 is sandwiched between the plate-shaped members 142*a* and 142*b*. In this manner, the processing target 200 is secured to the securing jig 120. The work of securing the processing target 200 to the securing jig 120 may be performed after the securing jig 120 is attached to the second base member 102*d* or before the securing jig 120 is attached to the second base member 102*d*.

As shown in FIG. 1, the above-described moving mechanism included in the stamping device 10 includes an elevation member 108, a slidable member 112 and a carriage 116. The elevation member 108 is configured so as to be slidable along guide rails 106*a* and 106*b* extending in the Z axis direction respectively in the vicinity of the side members 104L and 104R. The slidable member 112 is configured so as to be slidable along guide rails 110*a* and 110*b* extending in the Y axis direction below the elevation member 108. The carriage 116 is configured so as to be slidable along guide rails 114*a* and 114*b* extending in the X axis direction between front portions of the slidable member 112. The stamping head 118 is provided on the carriage 116. On a top surface of the elevation member 118, a laser pointer 150 is provided. The laser pointer 150 directs light to a central position or a substantially central position of an area of the surface 200*a* of the processing target 200 on which stamping is to be performed.

The stamping head 118 includes a processing tool 136 and a holder 138 to which the stamping tool 136 is detachably attached. The processing tool 136 vibrates in the Z axis direction and forms a stamping indentation having a predetermined depth onto the surface 200*a* of the processing target 200. The processing tool 136 is provided above the second base member 102*d*. The overall operations including operations of moving the elevation member 108, the slidable member 112 and the carriage 116, a stamping operation performed on the surface 200*a* of the processing target 200 by the stamping head 118 and the like are controlled preferably by a microcomputer (not shown).

On a bottom surface of the top member 122, a stepping motor 124 controllable to be driven preferably by the microcomputer (not shown) is provided. A Z-axis direction feed screw 126 is connected to the stepping motor 124. A screw shaft of the Z-axis direction feed screw 126 on which a thread is provided extends in the Z axis direction. The screw shaft of the Z-axis direction feed screw 126 rotates about the Z axis direction when the stepping motor 124 is driven. The Z-axis direction feed screw 126 runs through a central or substantially central position of the elevation member 108. In a through-hole through which the Z-axis direction feed screw 126 runs, a feed nut 108*a* is provided. The Z-axis direction feed screw 126 is threaded with the feed nut 108*a*. Because of such a structure, when the stepping motor 124 is driven, the Z-axis direction feed screw 126 is rotated and thus the elevation member 108 moves upward and downward in the Z axis direction.

At a rear end of the elevation member 108, a stepping motor 128 controllable to be driven by the microcomputer (not shown) is provided. A Y-axis direction feed screw 130 is connected to the stepping motor 128. A screw shaft of the Y-axis direction feed screw 130 on which a thread is provided extends in the Y axis direction. The screw shaft of the Y-axis direction feed screw 130 rotates about the Y axis direction when the stepping motor 128 is driven. The Y-axis direction feed screw 130 runs through a top rear portion of the slidable member 112. In a through-hole through which the Y-axis direction feed screw 130 runs, a feed nut 112*a* is provided. The Y-axis direction feed screw 130 is threaded with the feed nut 112*a*. Because of such a structure, when the stepping motor 128 is driven, the Y-axis direction feed screw 130 is rotated and thus the slidable member 112 moves forward and rearward in the Y axis direction.

On a right front surface of the slidable member 112, a stepping motor 132 controllable to be driven preferably by the microcomputer (not shown) is provided. An X-axis direction feed screw 134 is connected to the stepping motor 132. A screw shaft of the X-axis direction feed screw 134 on which a thread is provided extends in the X axis direction. The screw shaft of the X-axis direction feed screw 134 rotates about the X axis direction when the stepping motor 132 is driven. The X-axis direction feed screw 134 runs through a side surface of the carriage 116. In a through-hole through which the X-axis direction feed screw 134 runs, a feed nut (not shown) is provided. The X-axis direction feed screw 134 is threaded with the feed nut. Because of such a structure, when the stepping motor 132 is driven, the X-axis direction feed screw 134 is rotated and thus the carriage 116 moves rightward and leftward in the X axis direction. Thus, the carriage 116 is movable three-dimensionally by the stepping motors 124, 128 and 132.

Figure 3:
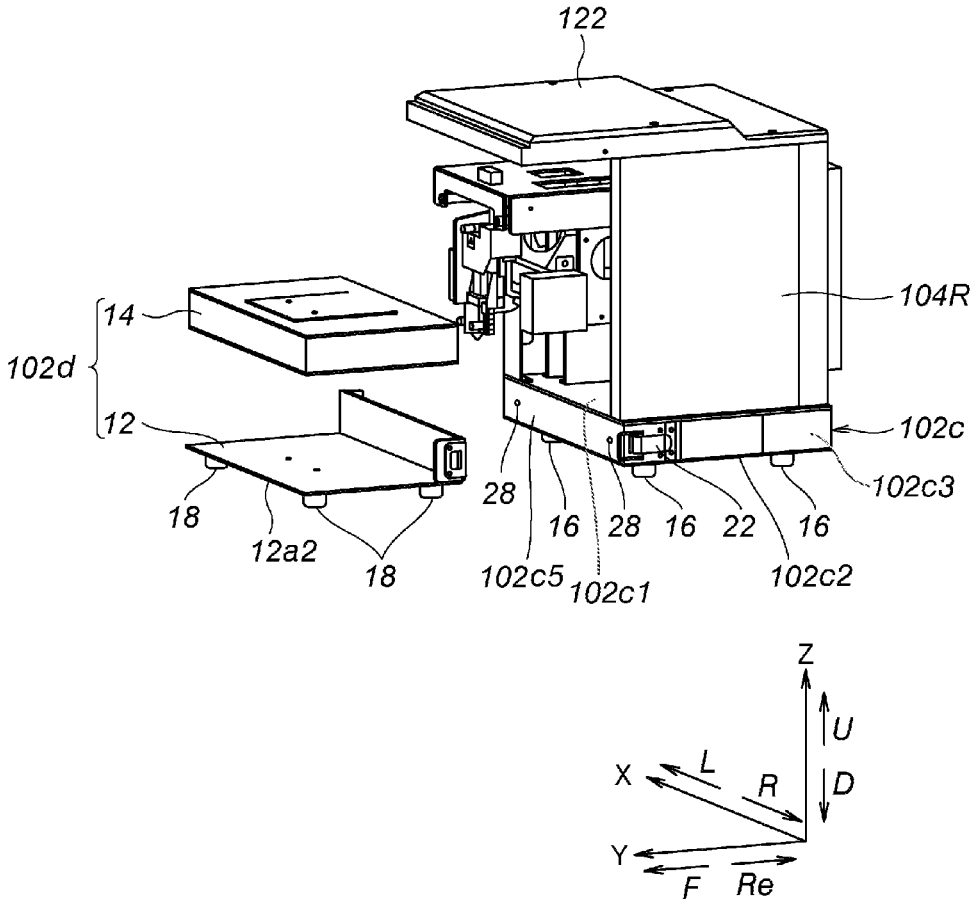
FIG. 3 is a perspective view of the stamping device according to a preferred embodiment of the present invention, including an exploded view of a base member.
Figure 4A:
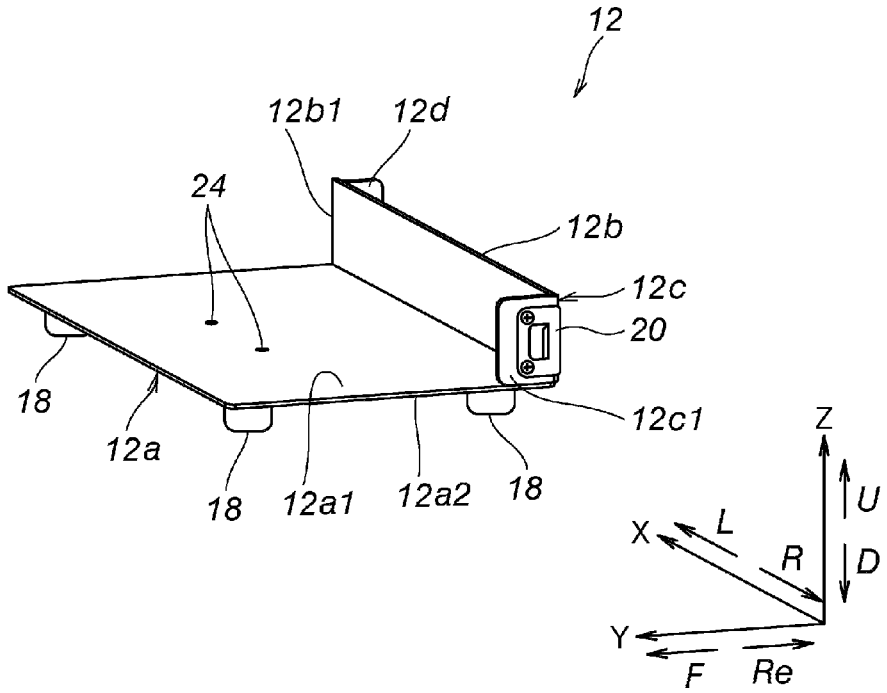
FIG. 4A and FIG. 4B are each a perspective view of a base table member in the stamping device according to a preferred embodiment of the present invention.
Figure 4B:
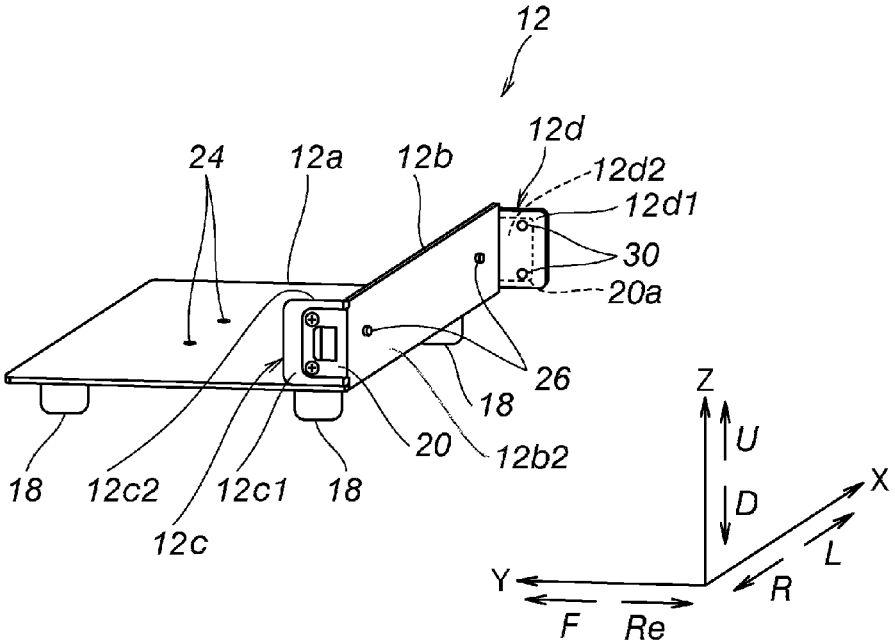

Now, the first base member 102*c* and the second base member 102*d* will be described in detail. As shown in FIG. 3, the second base member 102*d* includes a base table member 12 and a base plate 14. The base table member 12 is detachably attached to a front surface 102*c*5 of the first base member 102*c*, and may be formed of, for example, an L-shaped or substantially L-shaped metal plate. This will be described in more detail. As shown in FIG. 4A and FIG. 4B, the base table member 12 includes a square or substantially square, or rectangular or substantially rectangular first plate-shaped member 12*a* and a second plate-shaped member 12*b* extending upward vertically or substantially vertically from a rear end of the first plate-shaped member 12*a*. The second plate-shaped member 12*b* is detachably attached to the front surface 12*c*5 of the first base member 102*c* as described later in detail. The base plate 14 is detachably attached to the base table member 12. As shown in FIG. 1, a stamping direction of the processing tool 136 matches a direction in which the base plate 14 and the first plate-shaped member 12*a* overlap each other. The second plate-shaped member 12*b* has a height and a width that are equal or substantially equal to those of the base plate 14, respectively.

As shown in FIG. 4A and FIG. 4B, the second plate-shaped member 12*b* is provided with a first plate member 12*c* and a second plate member 12*d*. The first plate member 12*c* extends forward from a right end of the second plate-shaped member 12*b*. The second plate member 12*d* extends rearward from a left end of the second plate-shaped member 12*b*. The first plate member 12*c* is provided with an engagement member 20 on a right surface 12*c*1 thereof. The engagement member 20 is engageable with a latch fastener 22 (FIG. 3) on the first base member 102*c*. The second plate member 12*d* is provided with two third protrusion members 30 on a right surface 12*d*1 thereof. The two third protrusion members 30 are engageable with recessed portions 30*a* in the first base member 102*c* described later. The protrusion members 30 may be formed by, for example, half-piercing. Similarly, the first plate member 12*c* is provided with a plurality of protrusion members (not shown) on a left surface 12*c*2 thereof. These protrusion members are engageable with recessed portions (not shown) provided in a right surface of the base plate 14.

Figure 5A:
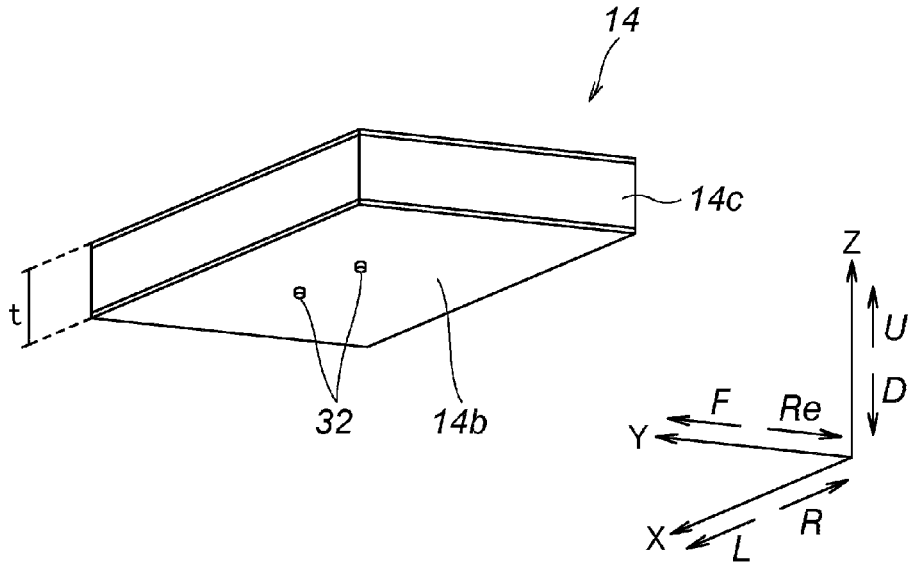
FIG. 5A and FIG. 5B are each a perspective view of a base plate in the stamping device according to a preferred embodiment of the present invention.
Figure 5B:
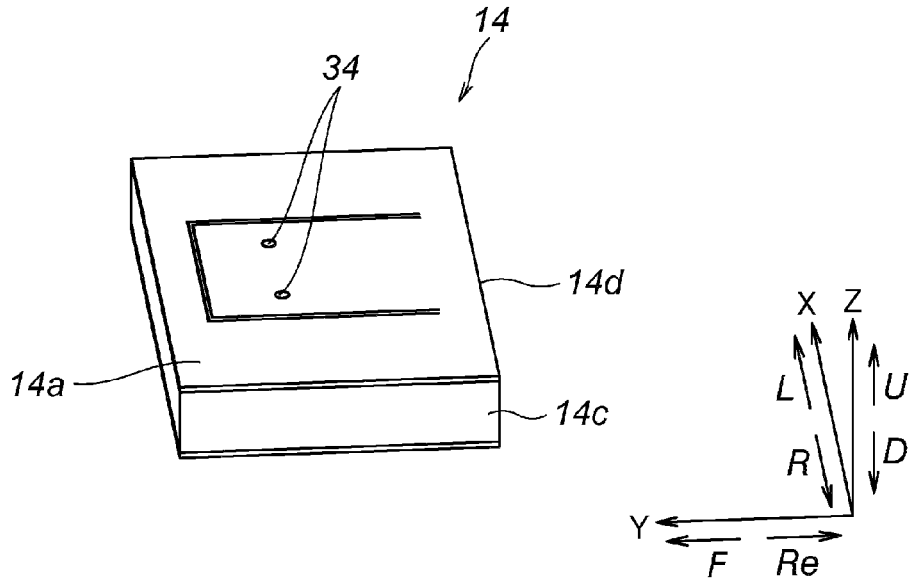

The second plate-shaped member 12*b* is provided with two pins (first protrusion members) 26 on a rear surface 12*b*2 thereof. As shown in FIG. 3, the first base member 102*c* is provided with first holes 28 in the front surface 102*c*5 thereof. The first holes are engageable with the pins 26. As shown in FIG. 5A and FIG. 5B, the base plate 14 preferably has a parallelepiped or substantially parallelepiped shape having thickness t and is provided with two pins (second protrusion members) 32 on a bottom surface 14*b* thereof. The pins 32 are provided in order to locate the base plate 14 in a position on a top surface 12*a*1 of the first plate-shaped member 12*a*. The base plate 14 is provided with two third holes 34 in a top surface 14*a* thereof. The third holes 34 are engageable with two pins (not shown) provided on a bottom surface 140*b* of the base table 140 of the securing jig 120.

As shown in FIG. 4A and FIG. 4B, the first plate-shaped member 12*a* is provided with second holes 24 that are engageable with the pins 32 provided on the base plate 14. The first plate-shaped member 12*a* is provided with legs 18 respectively at four corners of a bottom surface 12*a*2 thereof. The second holes 24 are also engageable with the pins (not shown) provided on the bottom surface 140*b* of the base table 140 of the securing jig 120. More specifically, the pins 32 on the base plate 14 are put into engagement with the second holes 24, and thus the base plate 14 is attached to the top surface 12*a*1 of the first plate-shaped member 12*a*. Alternatively, as described later, in this preferred embodiment, the pins (not shown) provided on the bottom surface 140*b* of the base table 140 are put into engagement with the second holes 24 in the state in which the base plate 14 is not attached to the base table member 12, and thus the securing jig 120 is attached to the top surface 12*a*1 of the first plate-shaped member 12*a*.

Figure 6A:
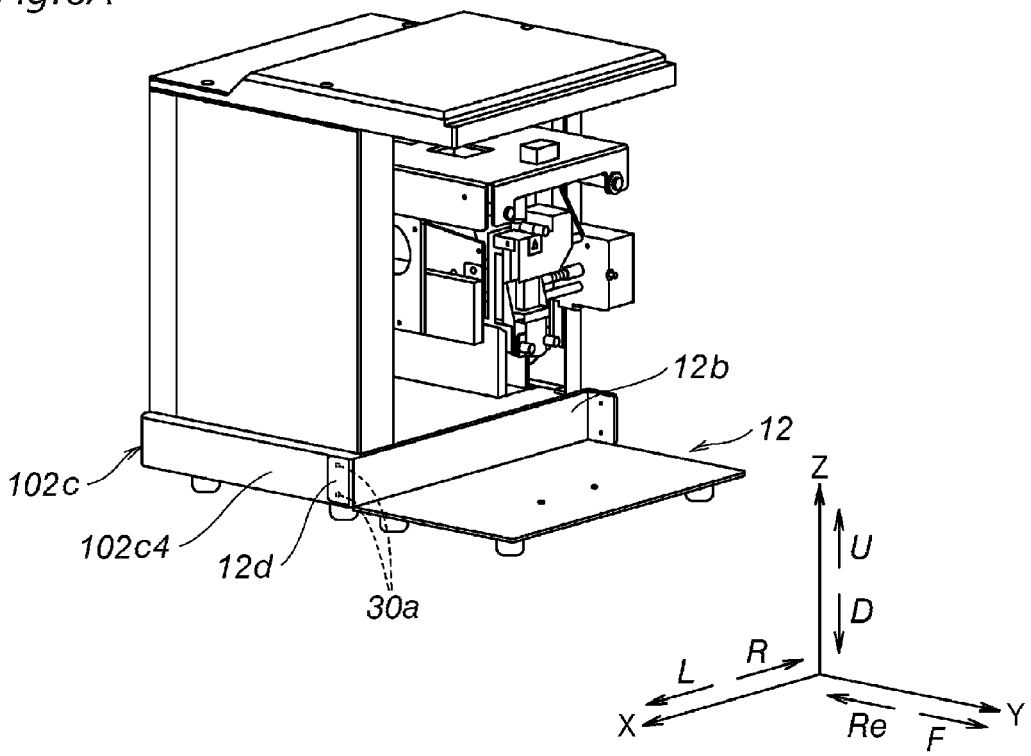
FIG. 6A is a perspective view of the stamping device according to a preferred embodiment of the present invention, showing a state in which the base table member is positioned on a front surface of a first base member.
Figure 6B:
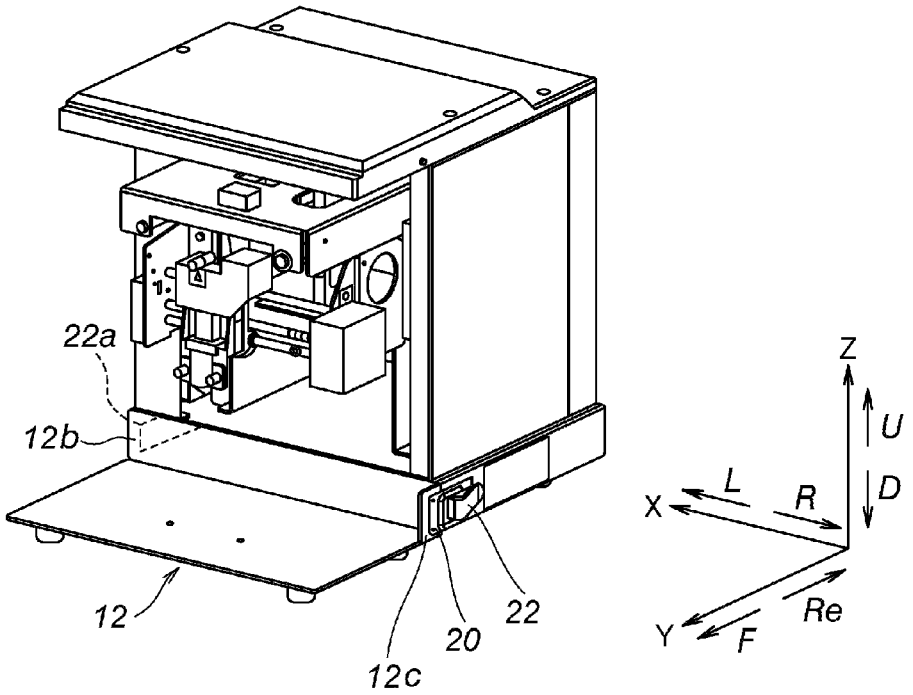
FIG. 6B is a perspective view of the stamping device according to a preferred embodiment of the present invention, showing a state in which the base table member is secured to the first base member.

As shown in FIG. 3, the first base member 102*c* is provided with legs 16 respectively at four corners of a bottom surface 102*c*2 thereof. The legs 16 have a length that is equal or substantially equal to that of the legs 18. As shown in FIG. 3 and FIG. 6B, the first base member 102*c* is provided with the latch fastener 22 on a front portion of a right surface 102*c*3 (another side surface) thereof. The latch fastener 22 is engageable with the engagement member 20. As shown in FIG. 6A, the first base member 102*c* is provided with the recessed portions 30*a* in a front portion of a left surface 102*c*4 (one side surface) thereof. The recessed portions 30*a* are engageable with the third protrusion members 30 provided on the second plate member 12*d* in the state in which the second base member 102*d* is attached to the first base member 102*c*.

With such a structure, the elements are positioned as follows. The pins 26 on the second plate-shaped member 12*b* are put into engagement with the first holes 28 in the first base member 102*c*, and the third protrusion members 30 on the second plate member 12*d* are put into engagement with the recessed portions 30*a* in the first base member 102*c*. In this state, the rear surface 12*b*2 of the second plate-shaped member 12*b* is in contact with the front surface 102*c*5 of the first base member 102*c*, and the right surface 12*d*1 of the second plate member 12*d* is in contact with the left surface 102*c*4 of the first base member 102*c*. As a result, the base table member 12 of the second base member 102*d* is positioned with respect to the first base member 102*c* such that the latch fastener 22 on the first base member 102*c* is engageable with the engagement member 20 on the base table member 12, in the state in which the second plate member 12*d* is in engagement with the left surface 102*c*4 of the first base member 102*c*. In addition, the base plate 14 is placed on the top surface 12*a*1 of the first plate-shaped member 12*a* and the pins 32 are put into engagement with the second holes 24. In this state, a front surface 12*b*1 of the second plate-shaped member 12*b* is in contact with a rear surface 14*d* of the base plate 14. As a result, the base plate 14 is positioned such that the left surface 12*c*2 of the first plate member 12*c* is contactable with a right surface 14*c* (one side surface) of the base plate 14. The securing jig 120 is placed on the top surface 14*a* of the base plate 14, and the pins (not shown) provided on the bottom surface 140*b* of the base table 140 are put into engagement with the third holes 34 of the base plate 14. As a result, the securing plate 120 is positioned with respect to the base plate 14.

With the stamping device 10 in this preferred embodiment, an assembly of the first base member 102*c* and the second base member 102*d* attached to the first base member 102*c*, the second base member 102*d* including the base table member 12 and the base plate 14 attached to the base table member 12, has a flat plate-shaped shape similar to that of the base member 102 of the conventional stamping device 100. Therefore, a "length in the Z axis direction between a bottom end of the processing tool 136 located at an uppermost position thereof by the elevation member 108 and the top surface 140*a* of the base table 140 of the securing jig 120 attached to the base plate 14" of the stamping device 10 in this preferred embodiment corresponds to the "distance between the processing tool 136 and the base table 140" of the conventional stamping device 100.

A two-dimensional symbol, for example, is formed on the surface 200*a* of the processing target 200 in the following manner. First, the processing target 200 is secured to the securing jig 120. Then, the stamping head 118 is moved preferably by control of the microcomputer to a stamping position at which the stamping on the surface 200*a* of the processing target 200 is to be performed. The position of the processing target 200 secured to the securing jig 120 is fine-adjusted such that light directed from the laser pointer 150 is located at a central or substantially central position of the area of the surface 200*a* of the processing target 200 on which stamping is to be performed. Next, various settings on the stamping force to be supplied by the processing tool 136 to the surface 200*a* of the processing target 200, the size of an image to be created by the stamping performed by the processing tool 136 (hereinafter, the image that is to be created or that is created by the stamping will be referred to as the "stamp image"), and the like are performed. Then, data (stamping data) used to control the stamping by the stamping head 118 on the surface 200*a* of the processing target 200 is created based on image data representing the two-dimensional symbol that is input to the microcomputer in advance and also based on the set stamping force.

Hereinafter, a non-limiting example of a method for performing stamping by the stamping device 10 in this preferred embodiment on the surface 200*a* of the processing target 200 will be described. First, a case where the thickness T of the processing target 200 is shorter than a distance G (see FIG. 1) between the processing tool 136 and the base table 140 of the securing jig 120 will be described.

Figure 7:
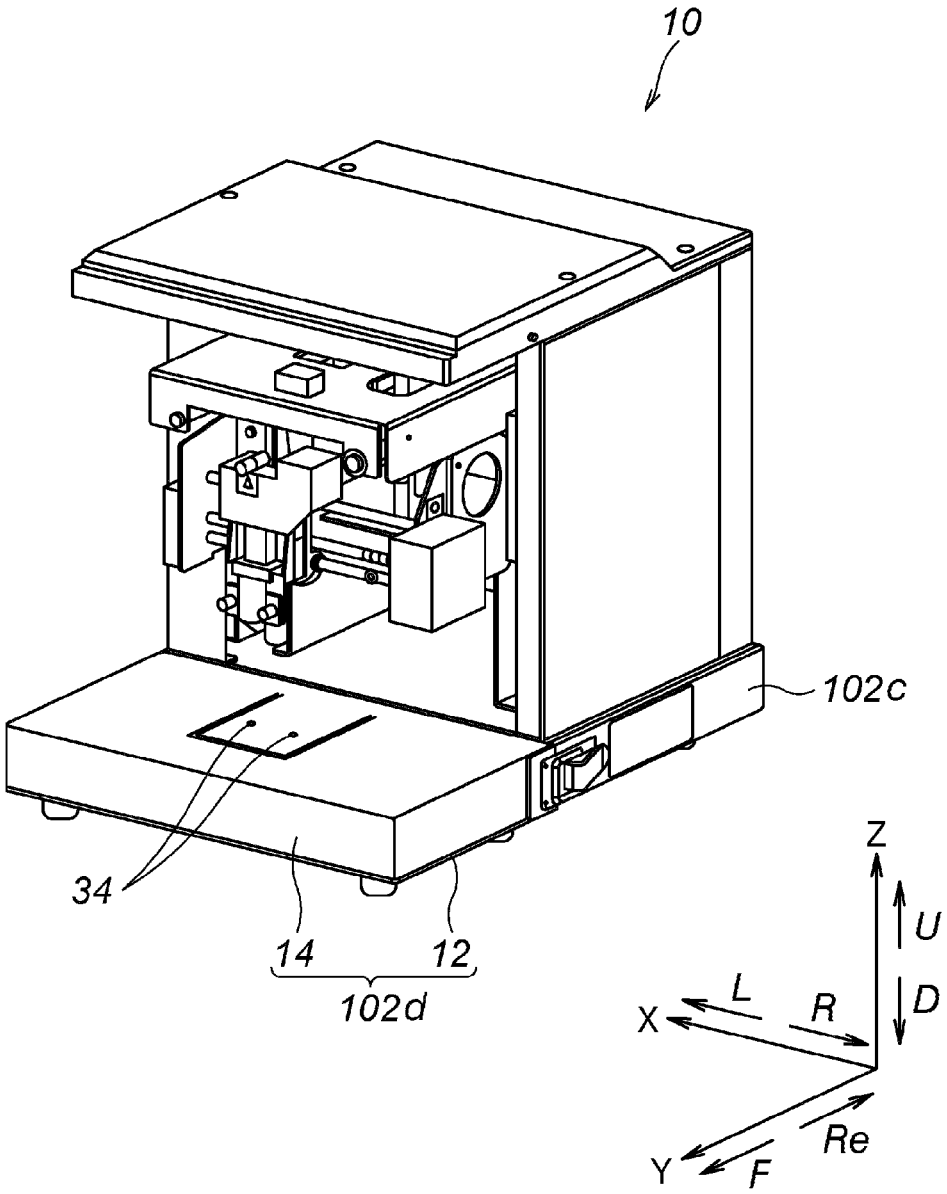
FIG. 7 is a perspective view of the stamping device according to a preferred embodiment of the present invention, showing a state in which the base plate is positioned and attached to the base table member.

As shown in FIG. 7, first, the second base member 102*d* is attached to the first base member 102*c*. In more detail, the pins 26 provided on the rear surface 12*b*2 of the second plate-shaped member 12*b* are put into engagement with the first holes 28 provided in the front surface 102*c*5 of the first base member 102*c*, and the third protrusion members 30 provided on the right surface 12*d*1 of the second plate member 12*d* are put into engagement with the recessed portions 30*a* provided in the left surface 102*c*4 of the first base member 102*c*. In this state, the rear surface 12*b*2 of the second plate-shaped member 12*b* is in contact with the front surface 102*c*5 of the first base member 102*c*, and the right surface 12*d*1 of the second plate member 12*d* is in contact with the left surface 102*c*4 of the first base member 102*c*. As a result, the base table member 12 of the second base member 102*d* is positioned with respect to the first base member 102*c* such that the latch fastener 22 on the first base member 102*c* is engageable with the engagement member 20 on the base table member 12, in the state in which the second plate member 12*d* is in engagement with the left surface 102*c*4 of the first base member 102*c*. Then, the latch fastener 22 is put into engagement with the engagement member 20 to secure the base table member 12 to the first base member 102*c*.

Next, the base plate 14 is placed on the first plate-shaped member 12*a* such that the bottom surface 14*b* of the base plate 14 is in contact with the top surface 12*a*1 of the first plate-shaped member 12*a*. At this point, the pins 32 provided on the bottom surface 14*b* of the base plate 14 are put into engagement with the second holes 24 provided in the top surface 12*a*1. In this state, the front surface 12*b*1 of the second plate-shaped member 12*b* is in contact with the rear surface 14*d* of the base plate 14, and the left surface 12*c*2 of the first plate member 12*c* is in contact with the right surface 14*c* of the base plate 14. As a result, the base plate 14 is located in position on the base table member 12.

Next, the pins (not shown) provided on the bottom surface 140*b* of the base table 140 are put into engagement with the third holes 34 of the base plate 14 to attach the securing jig 120 to the top surface 14*a* of the base plate 14. Then, the processing target 200 is secured to the securing jig 120. Stamping is performed on the surface 200*a* of the processing target 200 to form a stamp image on the surface 200*a*.

Now, a case where the thickness T of the processing target 200 is longer than or equal to the distance G between the processing tool 136 and the base table 140 and is shorter than a sum of the distance G and the thickness t of the base plate 14 will be described.

In this case, among the elements of the second base member 102*d*, only the base table member 12 is attached to the first base member 102*c*. The base plate 14 is not attached. This will be described in more detail. First, the pins 26 are put into engagement with the first holes 28, and the third protrusion members 30 are put into engagement with the recessed portions 30*a*. In this state, the rear surface 12*b*2 of the second plate-shaped member 12*b* is in contact with the front surface 102*c*5 of the first base member 102*c*, and the right surface 12*d*1 of the second plate member 12*d* is in contact with the left surface 102*c*4 of the first base member 102*c*. As a result, the base table member 12 of the second base member 102*d* is positioned with respect to the first base member 102*c* such that the latch fastener 22 on the first base member 102*c* is engageable with the engagement member 20 on the base table member 12, in the state in which the second plate member 12*d* is in engagement with the left surface 102*c*4 of the first base member 102*c*. Then, the latch fastener 22 is put into engagement with the engagement member 20 to secure the base table member 12 to the first base member 102*c*.

Next, the pins (not shown) provided on the bottom surface 140*b* of the base table 140 are put into engagement with the second holes 24 in the first plate-shaped member 12*a* to attach the securing jig 120 to the top surface 12*a*1 of the first plate-shaped member 12*a*. Then, the processing target 200 is secured to the securing jig 120. Stamping is performed on the surface 200*a* of the processing target 200 to form a stamp image on the surface 200*a*.

Now, a case where the thickness T of the processing target 200 is longer than or equal to the sum of the distance G between the processing tool 136 and the base table 140 and the thickness t of the base plate 14 will be described.

Figure 8:
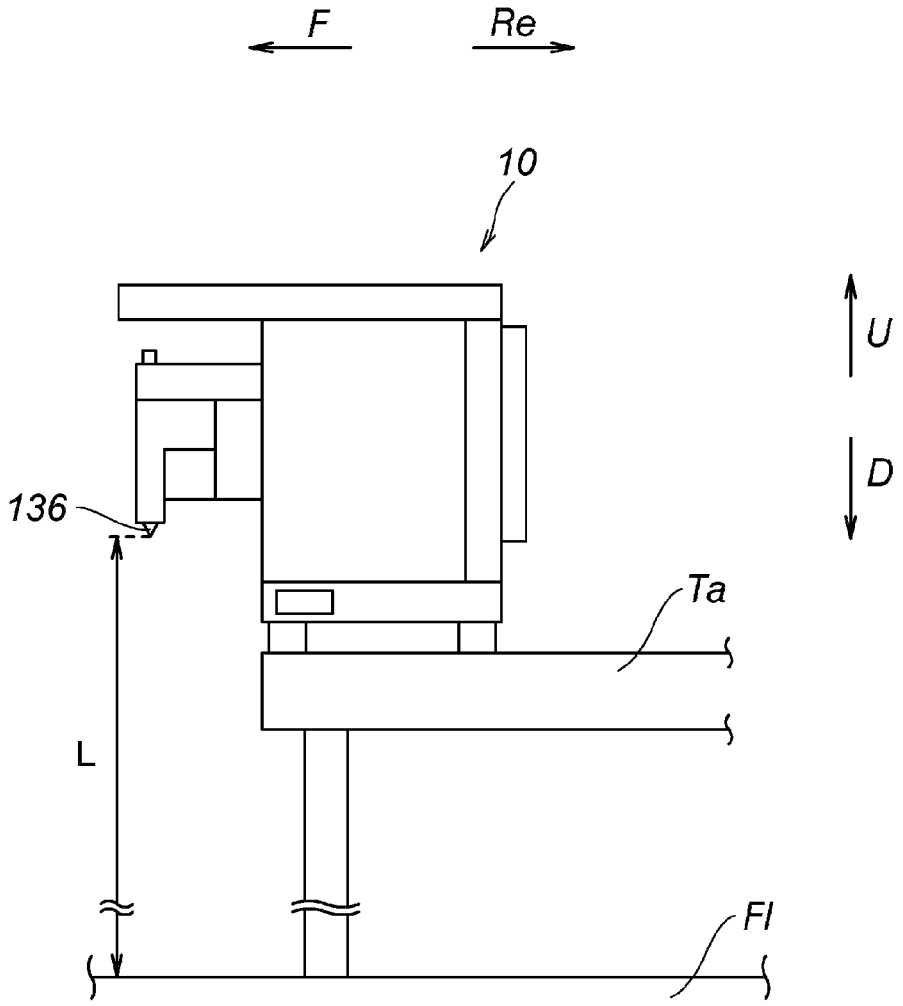
FIG. 8 is a side view of the stamping device to a preferred embodiment of the present invention that is placed on a table in a state in which a second base member is not attached to the first base member.
Figure 9:
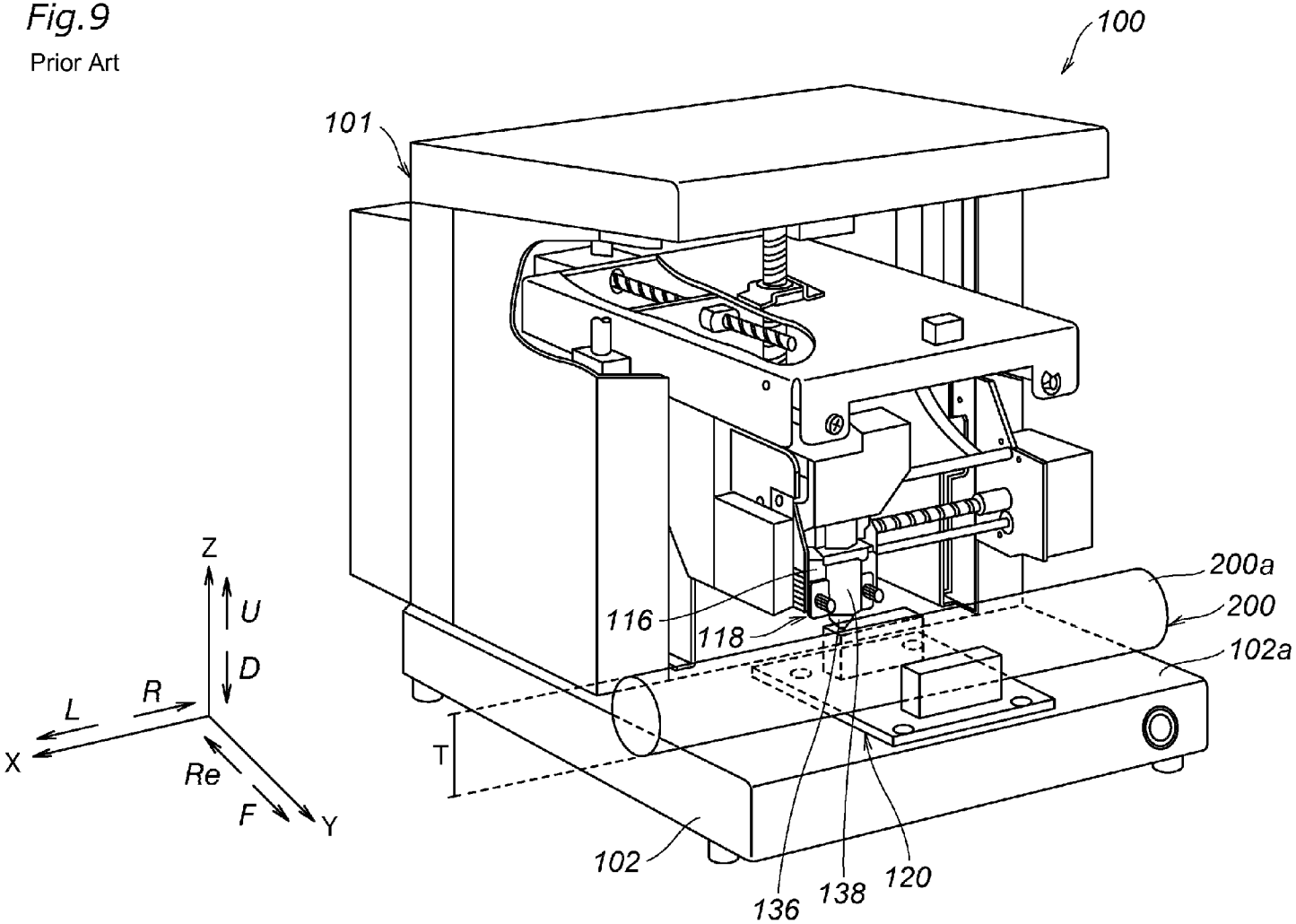
Fig.9 Prior Art
FIG. 9 is a partially cut-out perspective view of a conventional stamping device.
Figure 10:
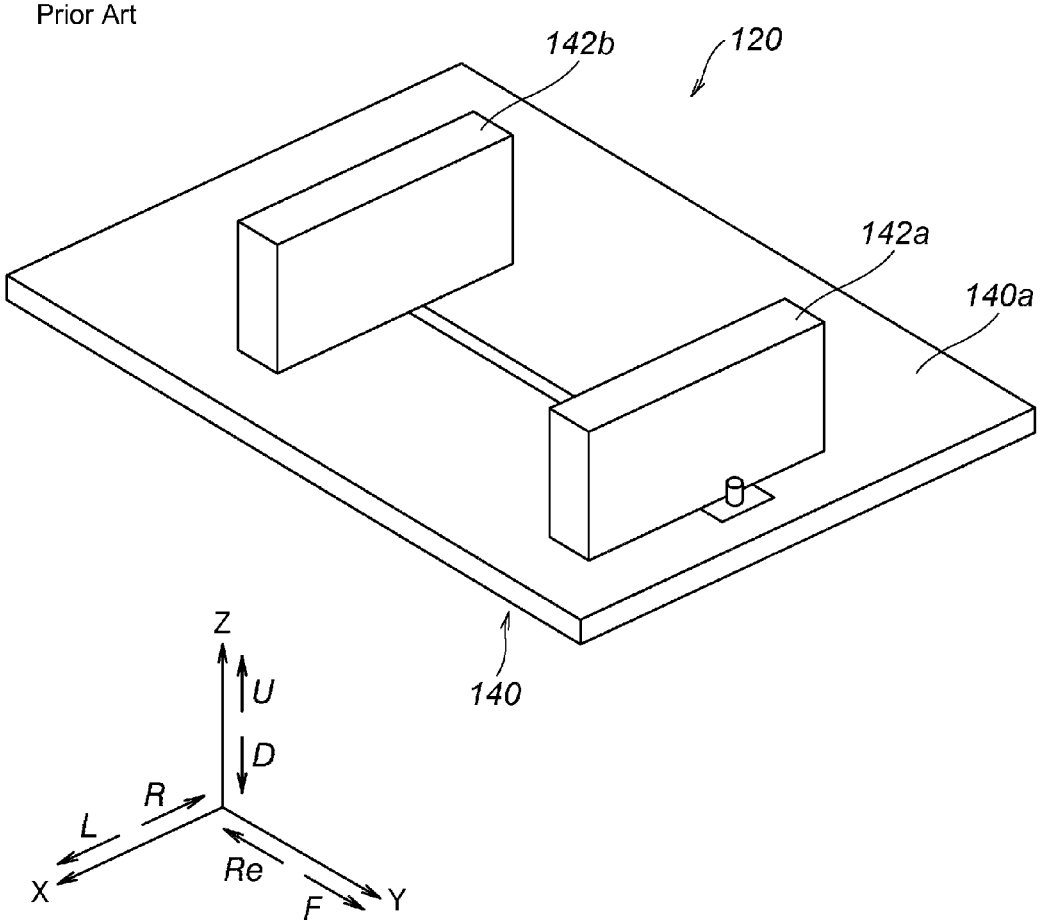
Fig.10 Prior Art
FIG. 10 is a perspective view of a securing jig provided in the conventional stamping device.

In this case, as shown in FIG. 8, the stamping device 10 in this preferred embodiment, in the state in which the second base member 102*d* is not attached to the first base member 102*c*, is placed at an end of, for example, a table Ta having a desired height. In this state, the processing target 200 is placed between the bottom end of the processing tool 136 and a floor F1 on which the table Ta is placed. Therefore, stamping can be performed on the processing target 200 having a thickness T that is, at the maximum, equal or substantially equal to length L from the bottom end of the processing tool 136 to the floor F1 on which the table Ta is placed. Then, the processing target 200 is secured such that the surface 200*a* of the processing target 200 is at a position where the processing tool 136 performs stamping on the surface 200*a*. Stamping is performed on the surface 200*a* of the processing target 200 to form a stamp image on the surface 200*a*.

As described above, in the stamping device 10 in this preferred embodiment, the base member 102 includes the first base member 102*c* and the second base member 102*d*. The second base member 102*d* is detachably attached to the front of the first base member 102*c*, above which the stamping head 118 is located. The second base member 102*d* includes the base table member 12 detachably attached to the front surface 102*c*5 of the first base member 102*c* and the base plate 14 detachably attached to the top surface 12*a*1 of the first plate-shaped member 12*a* of the base table member 12. The securing jig 120 is attachable to the top surface 12*a*1 of the first plate-shaped member 12*a* of the base table member 12 or to the top surface 14*a* of the base plate 14. Because of such a structure, the stamping device 10 is capable of performing stamping on the processing target 200 regardless of whether the thickness T of the processing target 200 is shorter than the distance G between the processing tool 136 and the base table 140, is longer than or equal to the distance G and is shorter than the sum of the distance G and the thickness t of the base plate 14, or is longer than or equal to the sum of the distance G and the thickness t of the base plate 14. Therefore, the stamping device 10 in this preferred embodiment is capable of performing stamping on various processing targets 200 that are significantly different in thickness. More specifically, the stamping device 10 in this preferred embodiment is capable of performing stamping even on a processing target 200 on which the conventional stamping device 100 cannot perform stamping due to the thickness T thereof (e.g., even when the thickness T exceeds the distance G between the processing tool 136 and the base table 140). As described above, the stamping device 10 in this preferred embodiment allows the base plate 14 of the second base member 102*d* to be attached or detached in accordance with the thickness T of the processing target 200 to perform stamping on the surface 200*a* of the processing target 200.

The above preferred embodiments may be modified as described below.

In the above preferred embodiments, the second base member 102*d* preferably includes two elements, namely, the base table member 12 and the base plate 14. The present invention is not limited to this. The second base member 102*d* may include one element, or may include three or more elements that are stacked in the Z-axis direction.

In the above preferred embodiments, the base table member 12 preferably is secured to the first base member 102*c* by the latch fastener 22. The present invention is not limited to this. The base table member 12 may be secured to the first base member 102*c* as follows, for example. The second plate-shaped member 12*b* of the base table member 12 is preferably made of a metal material, and a magnet is provided on an inner surface of the front surface 102*c*5 of the first base member 102*c*. The second plate-shaped member 12*b* is attracted to the front surface 102*c*5 of the first base member 102*c* by the magnet to secure the base table member 12 to the first base member 102*c*.

In the above preferred embodiments, two of the pins 26 preferably are provided, and two of the pins 32 preferably are provided. In correspondence therewith, two of the first holes 28 preferably are provided, and two of the second holes 24 preferably are also provided. Two pins are provided on the rear surface 140*b* of the base table 140 of the securing jig 120. In correspondence therewith, two of the third holes 34 engageable with these pins preferably are provided. As described above, two of the second holes 24, which are engageable with these pins, preferably are also provided. The present invention is not limited to this. The number of the pins and the number of the holes may be one, or three or more as long as the pins and the corresponding holes are provided in the same number.

In the above preferred embodiments, two of the protrusion members 30 provided on the right surface 12*d*1 of the second plate member 12*d* preferably are provided, and two of the recessed portions 30*a* preferably are provided in the left surface 102*c*4 of the first base member 102*c*. The present invention is not limited to this. The number of the protrusion members and the number of the recessed portions may be one, or three or more as long as the protrusion members and the corresponding recessed portions are provided in the same number.

The second holes 24 in the first plate-shaped member 12*a* and the third holes 34 in the base plate 14 preferably are arranged to match or substantially match each other positionally in the X axis direction and the Y axis direction when the base plate 14 is attached to the base table member 12. With such a structure, when the base plate 14 is attached to the base table member 12, the two second holes 24 are located just below the two third holes 34. Therefore, when the securing jig 120 is attached to the base plate 14 and when the securing jig 120 is attached to the base table member 12, the position of the origin of the securing jig 120 in the X axis direction and the Y axis direction is the same. This makes it easy to adjust the position of the processing target 200 with respect to the securing jig 120 at the time of securing the processing target 200 to the securing jig 120.

In the above preferred embodiments, the base table member 12 preferably is secured to the first base member 102*c* by the engagement member 20 provided on the right surface 12*c*1 of the first plate member 12*c* and the latch fastener 22 provided on the right surface 102*c*3 of the first base member 102*c*. The present invention is not limited to this. The stamping device 10 may further include an engagement member 20*a* provided on a left surface 12*d*2 of the second plate member 12*d* and also include a latch fastener 22*a*, engageable with the engagement member 20*a*, on the left surface 102*c*4 of the first base member 102*c*. With such a structure, the base table member 12 is preferably secured to the first base member 102*c* at both of the left side and the right side.

The above preferred embodiments and the modifications described above may be optionally combined.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiment described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A stamping device configured to perform stamping on a surface of a processing target, the stamping device comprising:

a processing tool configured to be movable in three axis directions perpendicular to one another;

a first base member configured to support the processing tool; and a second base member that is selectively attached to one surface of the first base member; wherein a securing member configured to secure the processing target is detachably attached to the second base member;

the processing tool is located above the second base member;

the second base member includes a first plate-shaped member, a second plate-shaped member extending upward from one end of the first plate-shaped member, and a base plate detachably attached to the first plate-shaped member and the second plate-shaped member and having the securing member detachably attached thereto;

the first plate-shaped member is provided with a second hole to attach the securing member;

the second plate-shaped member is detachably attached to the one surface of the first base member; and a stamping direction of the processing tool matches a direction in which the first plate-shaped member is attached to the base plate.

2. The stamping device according to claim 1, wherein the second plate-shaped member is provided with a first plate member extending in one direction from one end of the second plate-shaped member and is also provided with a second plate member extending in another direction opposite to the one direction from another end of the second plate-shaped member opposite to the one end of the second plate-shaped member;

in a state in which the second base member is attached to the one surface of the first base member, the second plate member is in contact with one side surface of the first base member that is perpendicular to the one surface of the first base member; and in a state in which the base plate is attached to the first plate-shaped member and the second plate-shaped member, one surface of the base plate is in contact with the second plate-shaped member, and the first plate member is in contact with one side surface of the base plate that is perpendicular to the one surface of the base plate.

3. A stamping device according to claim 2, wherein the second plate-shaped member is provided with a first protrusion member, and the first base member is provided with a first hole in the one surface thereof, the first hole being engageable with the first protrusion member;

the base plate is provided with a second protrusion member, and the second hole is engageable with the second protrusion member;

the first protrusion member and the first hole are engaged with each other, and the second plate-shaped member is in contact with the one surface of the first base member and also the second plate member is in contact with the one side surface of the first base member; and the second protrusion member and the second hole are engaged with each other, and the one surface of the base plate is in contact with the second plate-shaped member and also the first plate member is in contact with the one side surface of the base plate.

4. A stamping device according to claim 3, wherein the base plate is provided with a third hole to which the securing member is attachable; and in a state in which the based plate is attached to the first plate-shaped member, the second hole is located below the third hole.

5. A stamping device according to claim 2, wherein the second plate member is provided with a third protrusion member, and the first base member is provided with a recessed portion in the one side surface thereof, the recessed portion being engageable with the third protrusion member; and the third protrusion member and the recessed portion are engaged with each other, and thus the second plate member is in contact with the one side surface of the first base member.

6. A stamping device according to claim 2, wherein the first plate member is provided with a first engagement member that is engageable with the first base member; and another side surface of the first base member that is opposite to the one side surface thereof is provided with a first latch fastener engageable with the first engagement member.

7. A stamping device according to claim 6, wherein the second plate member is provided with a second engagement member that is located at a position different from that of the first engagement member and is engageable with the first base member; and the one side surface of the first base member is provided with a second latch fastener engageable with the second engagement member.

8. A stamping device according to claim 1, wherein when the thickness of the processing target is less than a distance between the processing tool and a base table of the securing member, the second base member is attached to the first base member.

9. A stamping device according to claim 1, wherein when the thickness of the processing target is greater than or equal to a distance between the processing tool and a base table of the securing member and the thickness of the processing target is less than a sum of a thickness of the base plate of the second base member and the distance between the processing tool and the base table of the securing member, the first plate-shaped member and the second plate-shaped member of the second base member are attached to the first base member and the base plate of the second base member is not attached to the first base member.

10. A stamping device according to claim 1, wherein when the thickness of the processing target is greater than or equal to a sum of a thickness of the base plate of the second base member and a distance between the processing tool and a base table of the securing member, the second base member is not attached to the first base member.

* * * * *